US010722050B1

(12) United States Patent
Stafford et al.

(10) Patent No.: US 10,722,050 B1
(45) Date of Patent: Jul. 28, 2020

(54) RETAIL DISPLAY UNIT WITH MOUNTING BRACKET ASSEMBLY

(71) Applicant: Target Brands, Inc., Minneapolis, MN (US)

(72) Inventors: William Y. Stafford, Minnetrista, MN (US); Jennifer A. Theisen, Crystal, MN (US); Stanley J. Valiulis, Rockford, IL (US); Gabriel Garduno, Minneapolis, MN (US); Somsay M. Rimpakone, Rockford, IL (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 16/541,341

(22) Filed: Aug. 15, 2019

(51) Int. Cl.

| | |
|---|---|
| ***A47F 5/08*** | (2006.01) |
| ***A47B 57/40*** | (2006.01) |
| ***A47B 96/07*** | (2006.01) |
| ***A47B 96/14*** | (2006.01) |

(52) U.S. Cl.
CPC ..... *A47F 5/0807* (2013.01); *A47B 57/40* (2013.01); *A47B 96/07* (2013.01); *A47B 96/1416* (2013.01); *A47B 96/1475* (2013.01)

(58) Field of Classification Search
CPC ..... A47F 5/0807; A47F 5/08; A47F 5/0815; A47F 5/0846; A47F 2005/0075; A47F 5/00; A47B 57/40; A47B 57/406; A47B 57/48; A47B 96/06; A47B 96/067; A47B 96/068; A47B 96/07; A47B 96/14; A47B 96/1408; A47B 96/1416; A47B 96/1466; A47B 96/1475; A47B 96/1483
USPC ..... 211/86.01, 87.01, 103, 187, 190, 175, 211/180; 248/220.21, 220.22, 220.42, 248/221.11, 223.41, 224.8, 225.11
See application file for complete search history.

(56) References Cited

U.S. PATENT DOCUMENTS

| | | | | | |
|---|---|---|---|---|---|
| 2,483,758 | A | * | 10/1949 | Douglas | A47B 96/07 248/242 |
| 3,529,798 | A | * | 9/1970 | Williams | G09F 7/18 248/469 |
| 3,561,714 | A | | 2/1971 | Zurawski et al. | |
| 3,794,281 | A | | 2/1974 | Munsey | |
| 3,830,374 | A | * | 8/1974 | Kassimir | A47F 5/103 211/1 |
| 3,971,477 | A | * | 7/1976 | Bruderly | A47F 5/103 211/189 |
| 4,021,973 | A | * | 5/1977 | Hegg | A47G 5/00 52/36.6 |
| 4,035,972 | A | | 7/1977 | Timmons | |

(Continued)

*Primary Examiner* — Jennifer E. Novosad
(74) *Attorney, Agent, or Firm* — Leanne Taveggia Farrell; Westman, Champlin & Koehler, P.A.

(57) ABSTRACT

A retail display unit includes a wall having a panel supported by first and second horizontal frame members and first and second vertical frame members. At least one slider is attached to the first vertical frame member and includes a channel. At least one mounting bracket assembly is slidably coupled to the at least one slider and includes at least one ear positioned in the channel of the at least one slider, at least one flange configured to mount to an upright of another retail display unit and a securing mechanism for tightening the at least one bracket assembly to the upright. The at least one ear is configured to slidably move inside the channel and thereby slidably adjust the position of the bracket assembly along a length of the at least one slider.

18 Claims, 8 Drawing Sheets

(56) References Cited

U.S. PATENT DOCUMENTS 4,046,083 A * 9/1977 Murdoch ..... A47F 5/103 108/107
4,197,685 A 4/1980 Goulish et al.
4,212,445 A * 7/1980 Hagen ..... F16B 12/34 248/222.52
4,401,222 A * 8/1983 Kulikowski ..... A47F 5/0025 211/94.01
4,616,799 A * 10/1986 Rebentisch ..... F16F 1/16 16/280
4,909,464 A * 3/1990 Levine ..... G09F 7/22 16/284
5,230,492 A 7/1993 Zwart et al.
5,244,186 A * 9/1993 Chandler ..... E04F 11/1812 248/223.41
5,255,803 A * 10/1993 Pavone ..... A47F 5/00 211/189
5,277,393 A * 1/1994 Nicholson ..... A47B 95/008 108/108
5,356,104 A * 10/1994 Rosenberg ..... A47B 96/061 248/223.41
5,373,793 A * 12/1994 Crossman ..... A47B 9/04 108/42
5,419,134 A * 5/1995 Gibson ..... G09F 1/10 248/223.41
5,433,327 A * 7/1995 Benvenuti ..... A47B 57/42 108/108
5,477,971 A * 12/1995 Howard ..... A47F 5/101 108/108
5,511,332 A * 4/1996 Sturkie ..... G09F 7/10 248/223.41
5,566,844 A * 10/1996 Bernardin ..... A47F 5/0846 211/162
5,722,623 A * 3/1998 Gibson ..... A47F 5/0068 248/201
5,865,562 A * 2/1999 Mallek ..... E06B 9/00 403/403
5,901,523 A * 5/1999 Tasi ..... A47B 57/54 248/223.41
5,950,974 A * 9/1999 Hoffmann ..... H02B 1/202 248/223.41
5,987,794 A * 11/1999 Lavi ..... G09F 15/0006 40/490
6,193,083 B1 * 2/2001 Wood ..... A47B 57/425 211/103
6,206,212 B1 * 3/2001 Loew ..... A47F 5/04 211/162
6,349,911 B1 * 2/2002 Feldpausch ..... A47B 57/34 211/90.02
6,364,262 B1 * 4/2002 Gibson ..... A47F 5/0068 248/229.14
6,427,857 B1 * 8/2002 Adams ..... A47F 5/10 211/162
6,481,679 B1 * 11/2002 Bennett ..... A61G 13/101 248/223.41
6,658,776 B1 * 12/2003 Pynenburg ..... G09F 7/00 40/605
6,675,978 B2 * 1/2004 Shea ..... A47F 5/0823 211/181.1
6,751,914 B2 * 6/2004 Zeh ..... A47B 83/001 108/60
6,966,267 B2 11/2005 Bienick
7,128,223 B1 * 10/2006 Sarnoff ..... A47F 5/083 211/90.03
7,147,114 B2 12/2006 Sarnoff et al.
7,387,213 B1 * 6/2008 Smalley ..... A47B 57/482 211/106
7,954,656 B1 * 6/2011 Cuzzocrea ..... A47F 5/103 211/189
8,230,628 B2 * 7/2012 Recker ..... E01F 9/669 40/606.14
8,231,016 B2 * 7/2012 Berdahl ..... A47F 3/12 211/119.003
8,752,718 B2 * 6/2014 Stukenberg ..... A47G 25/0664 211/87.01
8,782,936 B2 * 7/2014 Logan ..... G09F 7/10 40/606.01
8,807,356 B2 * 8/2014 Weigand ..... A47F 5/10 211/183
8,864,087 B2 * 10/2014 Goldin ..... A47B 13/003 248/222.14
9,629,484 B2 4/2017 Brozak
9,661,921 B1 * 5/2017 Tsai ..... A47B 57/50
10,058,172 B2 * 8/2018 Staib ..... A47B 96/1441
10,470,590 B2 * 11/2019 Wills ..... A47F 5/0884
2006/0016774 A1 * 1/2006 Bustos ..... A47B 45/00 211/186
2007/0017888 A1 * 1/2007 Falvey ..... A47B 57/42 211/205
2007/0125730 A1 6/2007 McLaughlin et al.
2008/0000861 A1 * 1/2008 Muellerleile ..... A47B 96/06 211/94.01
2009/0091881 A1 * 4/2009 Lee ..... F16M 11/046 361/679.21
2010/0282697 A1 * 11/2010 Weigand ..... A47F 7/144 211/50
2014/0353269 A1 * 12/2014 Trinh ..... A47F 5/10 211/183
2015/0260335 A1 * 9/2015 Lortie ..... F16B 12/12 248/223.41
2015/0374145 A1 * 12/2015 Lindblom ..... A47F 5/101 211/187
2016/0037943 A1 * 2/2016 Brozak ..... A47F 7/0014 211/43

* cited by examiner

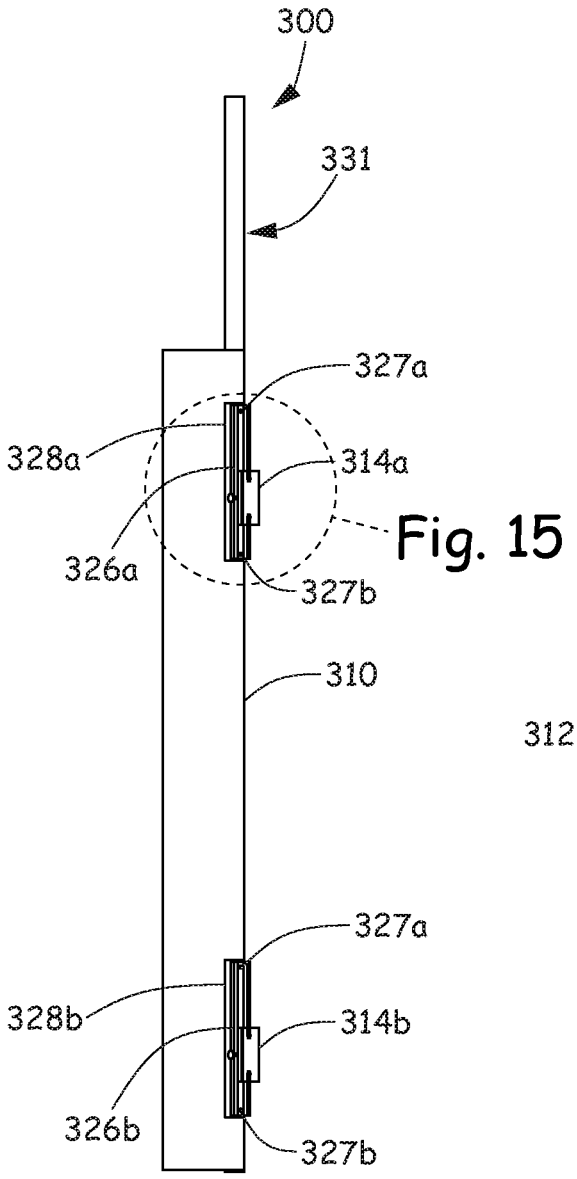
Fig. 15
Fig. 3
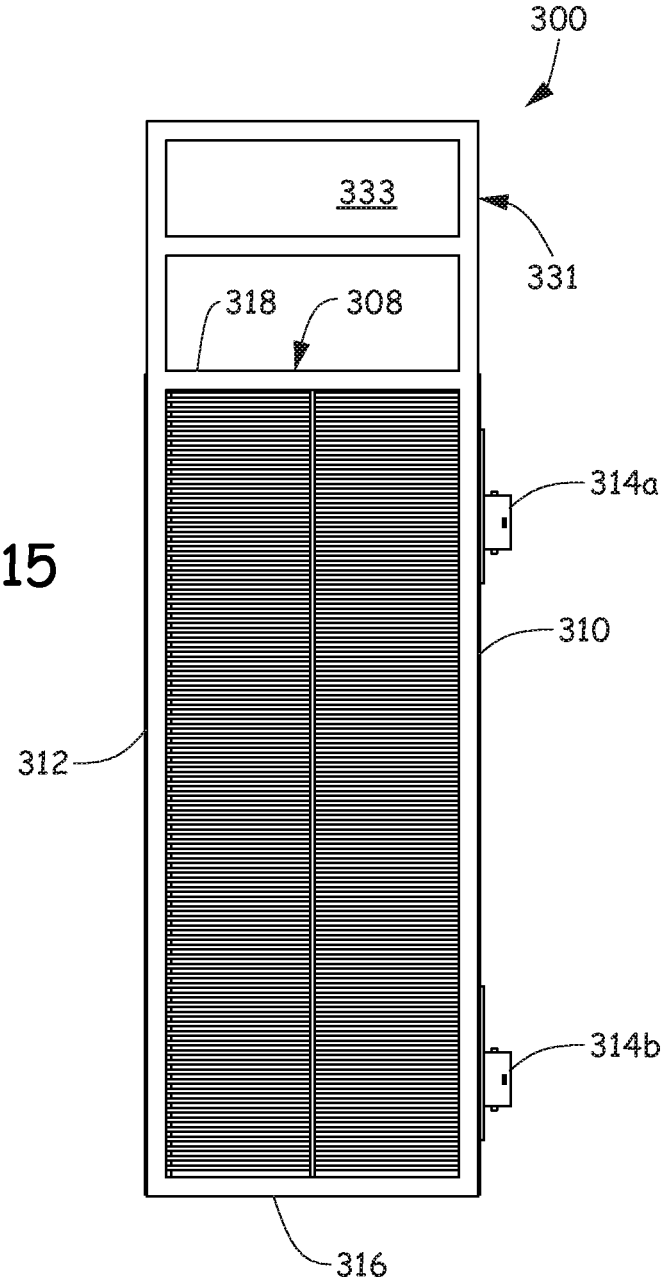
Fig. 4

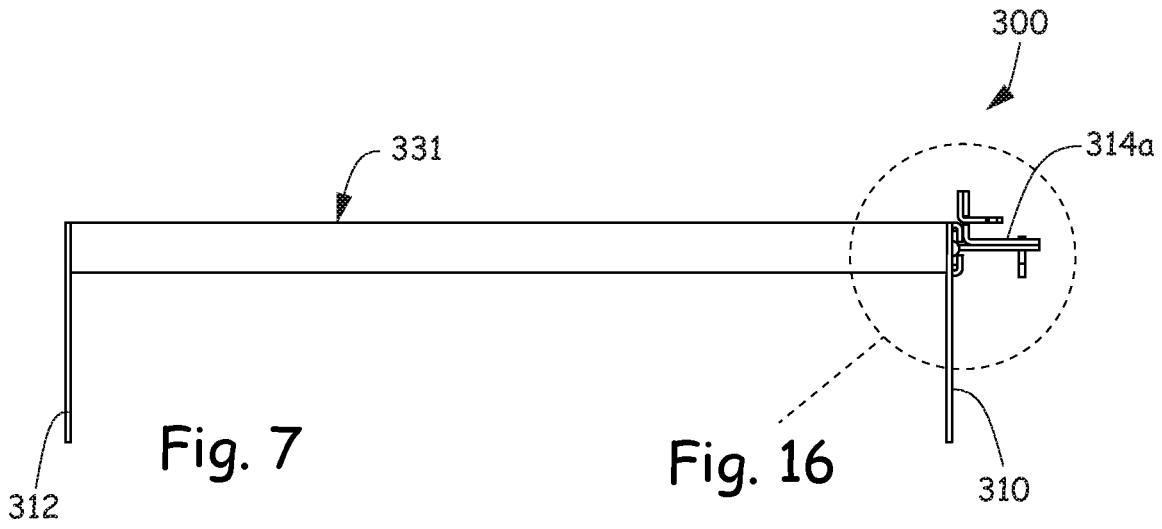
Fig. 7
Fig. 16
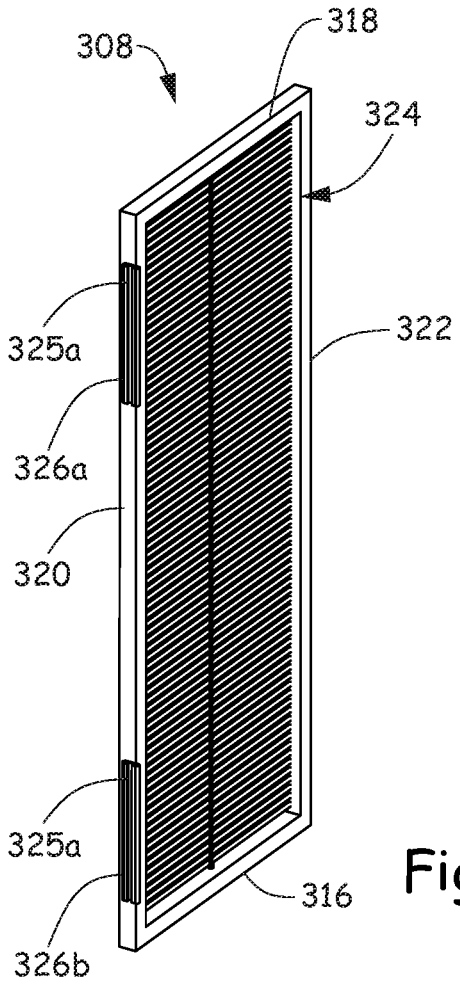
Fig. 8

RETAIL DISPLAY UNIT WITH MOUNTING BRACKET ASSEMBLY

BACKGROUND

Retail stores use a variety of retail display units to present products to customers for purchase. End cap display units are located at the end of an aisle of gondola display fixtures. While customers peruse the aisles, their eyes are automatically drawn to the end cap and therefore the end cap is a good location for featured items, such as items that are on sale, on promotion, new, seasonal or popular. An additional way to maximize the real estate of the end cap is to add a side cap display to the end cap.

The discussion above is merely provided for general background information and is not intended to be used as an aid in determining the scope of the claimed subject matter.

SUMMARY

A retail display unit includes a wall, at least one slider and at least one mounting bracket assembly. The wall has a panel supported by first and second horizontal frame members and first and second vertical frame members. The at least one slider is attached to the first vertical frame member and includes a channel. The at least one mounting bracket assembly is slidably coupled to the at least one slider and includes at least one ear positioned in the channel of the at least one slider, at least one flange configured to mount to an upright of another retail display unit and a securing mechanism for tightening the at least one bracket assembly to the upright. The at least one ear is configured to slidably move inside the channel and thereby slidably adjust the position of the bracket assembly along a length of the at least one slider.

A retail display includes an end cap retail display unit having a back wall supported by first and second uprights and a base deck and a side cap retail display unit coupled to the first upright of the end cap display unit. The side cap retail display unit includes a wall having a panel supported by first and second horizontal members and first and second vertical members, at least one slider coupled to the first vertical member and including a channel and at least one mounting bracket assembly configured to mate with the channel and slidably move along a length of the at least one slider to a desirable position and configured to mount to the first upright. The at least one mounting bracket assembly includes a securing mechanism for tightening the at least one bracket assembly to the first upright. The desirable position ensures that the first horizontal member is justified with the base deck of the end cap and the at least one mounting bracket assembly does not interfere with shelves mounted to the first upright.

A method is provided of mounting a side cap retail display unit to an upright of an endcap display unit. The method includes sliding at least one ear of at least one mounting bracket assembly along a channel of a slider to a desirable position. The slider is fixed to a first vertical frame member of a wall of the side cap retail display unit. The method further includes mounting at least one flange of the at least one mounting bracket assembly to the upright of the endcap display unit and securing the at least one mounting bracket assembly to the upright. The desirable position of the at least one mounting bracket assembly along the channel of the slider ensures that a bottom of the wall of the side cap retail display unit is justified with a base deck of the endcap display unit while the at least one flange of the at least one mounting bracket assembly does not interfere with shelves of the endcap display unit that are mounted to the upright.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 3 is a right side view of FIG. 2.

FIG. 4 is a front view of FIG. 2.

FIG. 7 is a top view of FIG. 2.

FIG. 8 is a back perspective view of a wall of the side cap retail display unit of FIGS. 2-7.

DETAILED DESCRIPTION

A side cap retail display unit attaches to an upright on an end cap of a gondola display fixture—the same upright that also receives shelf mounting brackets for the end cap. Under the prior art, if the slot needed for a shelf bracket of the endcap is the same slot as needed for the side cap, then the side cap is detrimentally mounted to a different slot so that the bottom of the side cap is not justified with the base deck of the endcap for stability.

Figure 1:
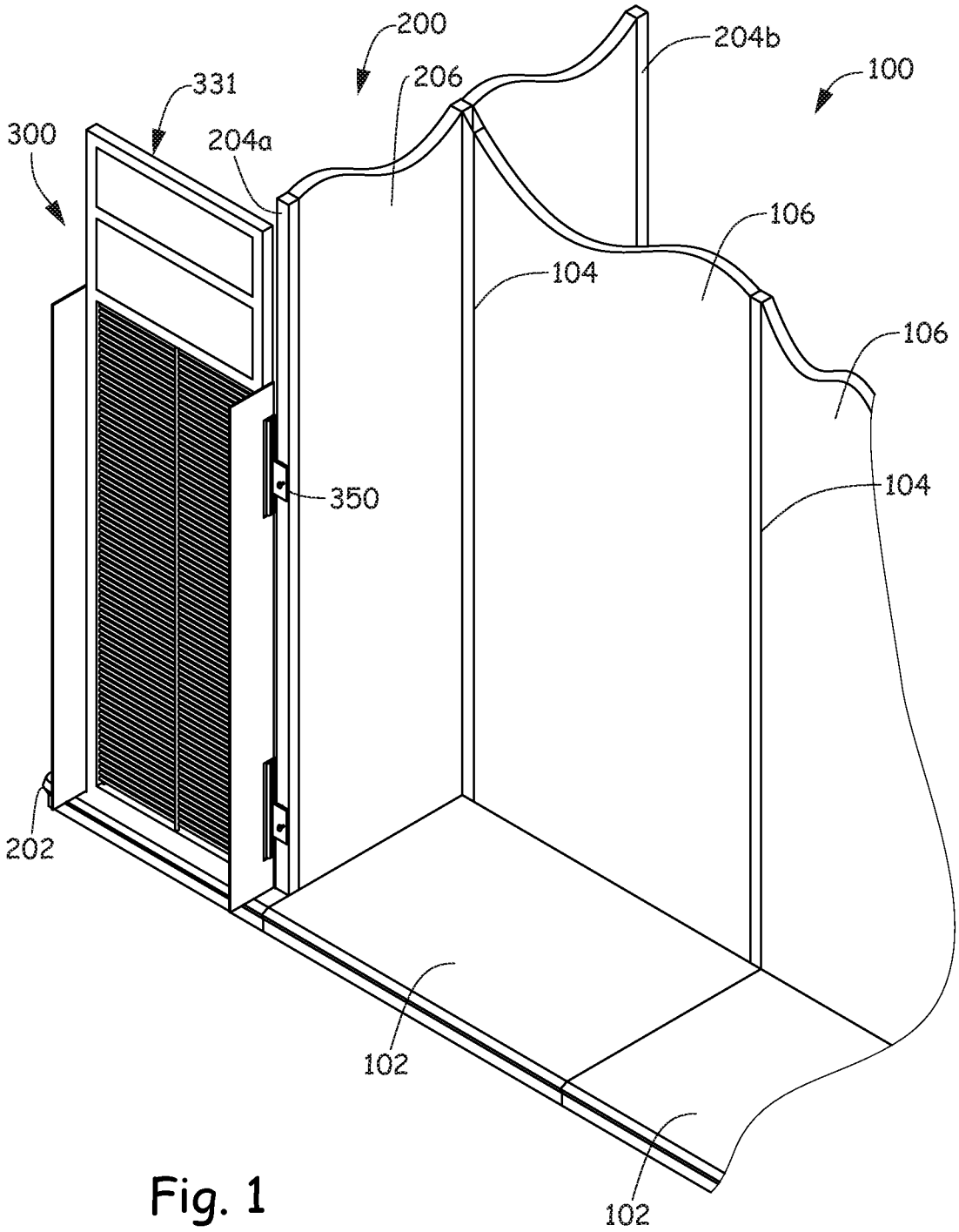
FIG. 1 is a perspective view of a gondola display fixture including an end cap retail display unit with a side cap retail display unit.

FIG. 1 is a perspective view of a gondola display fixture 100 including an end cap 200 with a side cap retail display unit 300 attached. Gondola display fixture 100 includes a plurality of base decks 102, plurality of uprights 104 and a plurality of back walls 106 attached to the plurality of uprights. End cap 200 includes a base deck 202, a pair of uprights 204*a* and 204*b* and a back wall 206. The front of endcap 200 is at the end of the aisle of gondola display fixture 100.

Figure 2:
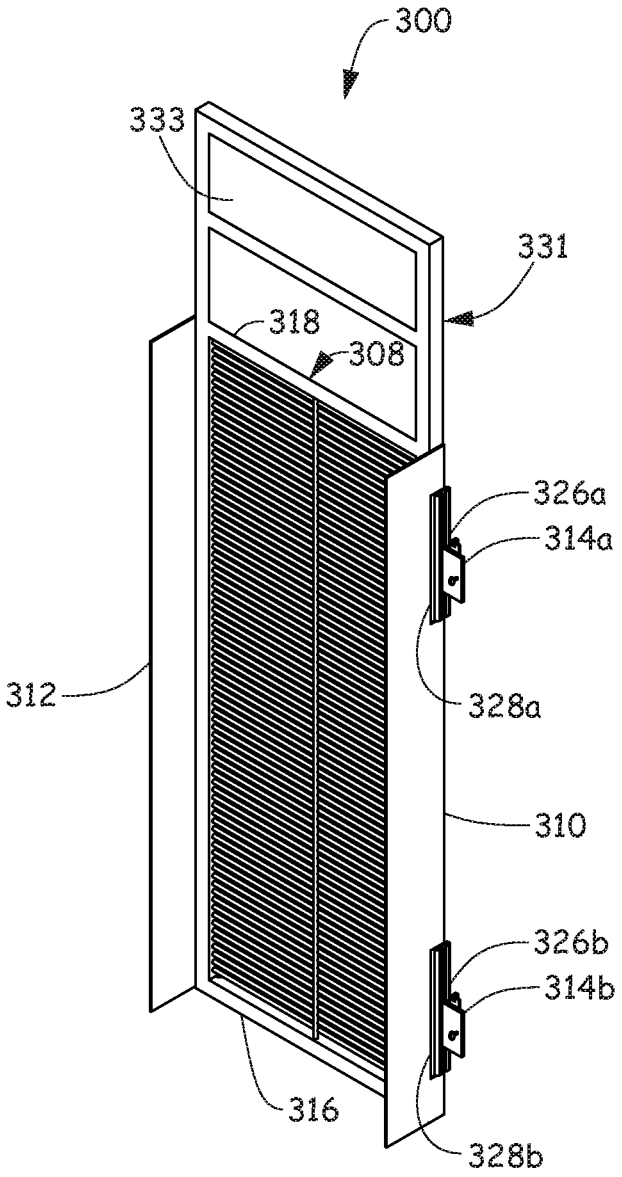
FIG. 2 is a perspective view of the side cap retail display unit of FIG. 1.
Figure 5:
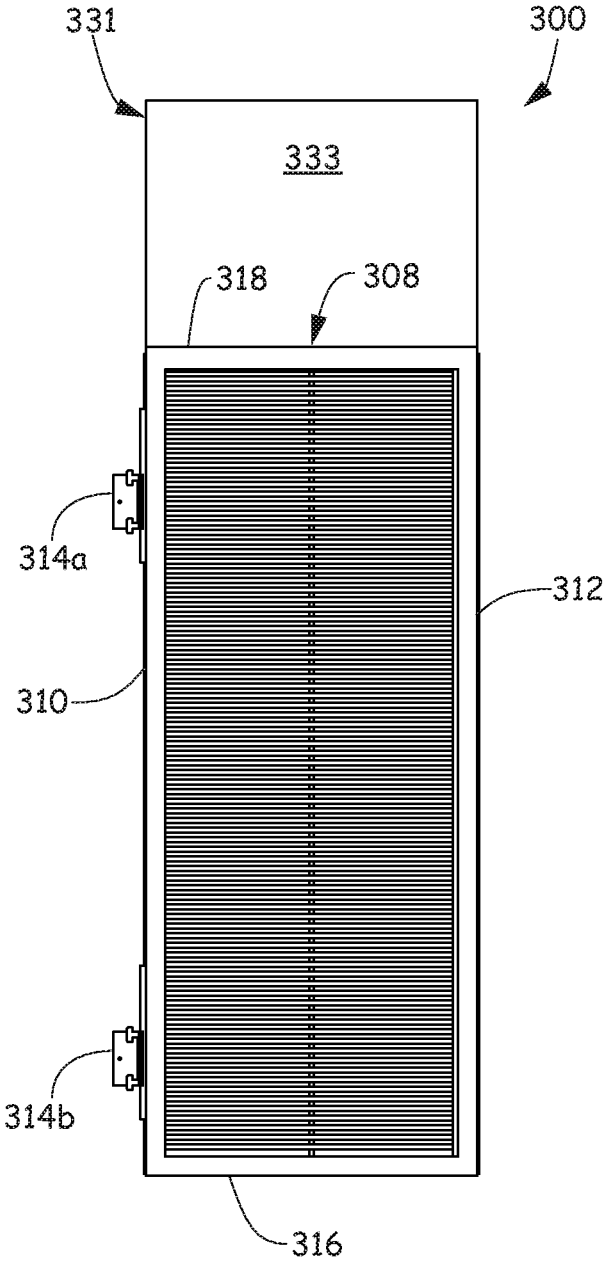
FIG. 5 is a back view of FIG. 2.
Figure 6:
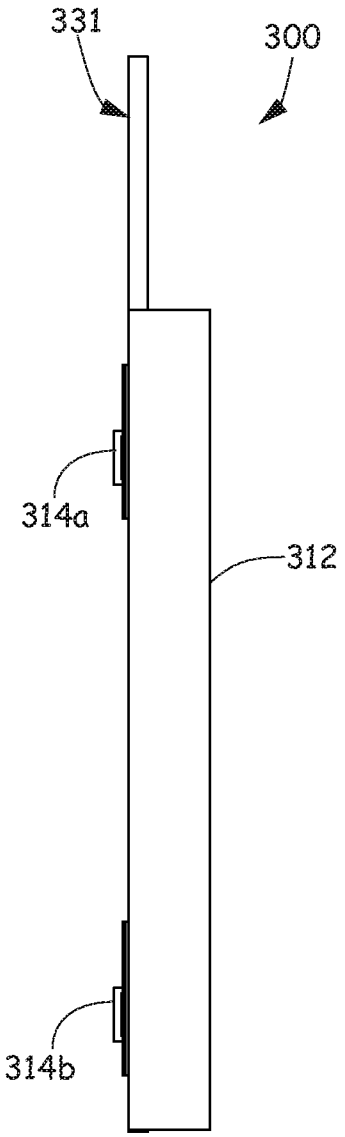
FIG. 6 is a left side view of FIG. 2.

FIG. 2 is a perspective view of side cap retail display unit 300 of FIG. 1. FIG. 3 is a right side view, FIG. 4 is a front view, FIG. 5 is a back view, FIG. 6 is a left side view and FIG. 7 is top view of side cap retail display unit 300. Side cap retail display unit 300 includes a wall 308, a first side fence 310 attached to a first side of wall 308, a second side fence 312 attached to a second side of wall 308 and at least one mounting bracket assembly 314 for attaching side cap 300 to an end cap of a gondola display fixture, such as endcap 200 of gondola display fixture 100.

Figure 9:
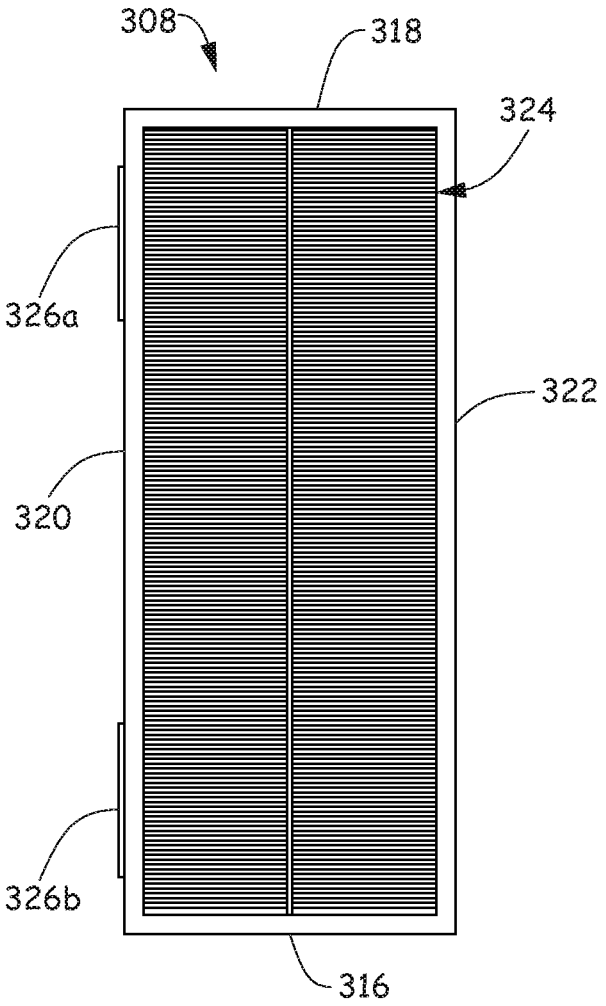
FIG. 9 is a back view of FIG. 8 with the front view being a mirror image.
Figure 10:
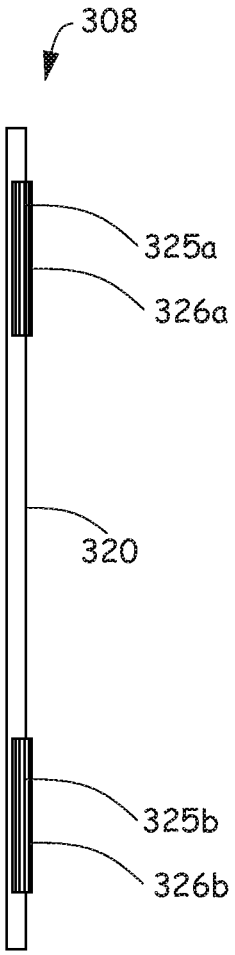
FIG. 10 is a right side view of FIG. 8.

FIG. 8 is a perspective view of wall 308 of side cap 300. FIG. 9 is a back view of wall 308 and FIG. 10 is a right side view of wall 308. Wall 308 includes a first horizontal frame member 316, a second horizontal frame member 318, a first vertical frame member 320 and a second vertical frame member 322 and a panel 324. Each of the frame members 316, 318, 320 and 322 support panel 324, which is configured to receive display accessories, such as peg hooks, bins, shelves and the like. In the FIGS. 8-10 embodiment, panel 324 is a grid panel, however, it should be realized that in other embodiments, frame members 316, 318, 320 and 322 may support other types of panels, such as a pegboard panel. Attached to first vertical frame member 320 is at least one slider 326. In FIGS. 8-10, a pair of sliders 326*a* and 326*b* are attached to first vertical frame member 320. Each slider 326*a* and 326*b* includes respective channels 325*a* and 325*b*. Each channel 325*a* and 325*b* includes a lengthwise opening that faces outwardly from first vertical frame member 320 and openings at opposing ends of sliders 326*a* and 326*b*.

As illustrated in FIGS. 8-10, wall 308 is oriented in a first position. In the first position, first horizontal frame member 316 is located on a top of wall 308 and second horizontal frame member 318 is located on a bottom of wall 308. In addition, first vertical frame member that includes the pair of sliders 326*a* and 326*b* are on the right side of wall 308. Also in this first position, sliders 326*a* and 326*b* are positioned so as to receive mounting bracket assemblies that are to be mounted onto a right upright 204*a* of endcap 200. In other words, the orientation of wall 308 is such that side cap 300 is mounted on the right side of end cap 200. It should be realized that wall 308 can be oriented in another or different second position. In the second position, wall 308 is vertically rotated or turned upside down so that first horizontal frame member 316 is located on bottom, second horizontal frame member 318 is located on top, first vertical frame member 320 including the pair of sliders 326*a* and 326*b* are located on the left side and second vertical frame member 322 is located on the right side. In this second position, sliders 326*a* and 326*b* are positioned so as to receive mounting bracket assemblies that are to be mounted onto a left upright 204*b* of end cap 200. Because of these two different positions, a sign frame 331, as illustrated in FIGS. 1-7, is removably mounted to first horizontal frame member 316 when wall 308 is in the first position. When wall 308 is in the second position, sign frame 331 is removably mounted to second horizontal frame member 318.

As illustrated in FIGS. 1-7, first side fence 310 is mounted to first vertical frame member 320 and includes elongated openings 328*a* and 328*b*. Each elongated opening 328*a* and 328*b* corresponds with a length of each slider 326*a* and 326*b* of first side member 320, respectively, so that first side fence 310 is flush with first side member 320 and allows each slider 326*a* and 326*b* to protrude through respective elongated openings 328*a* and 328*b*. Second side fence 312 is mounted to second side member 322. An upper frame 331 is coupled to first and second vertical frame members 320 and 322. Under one embodiment, upper frame 331 supports a backer 333 and other signage as needed.

Figure 11:
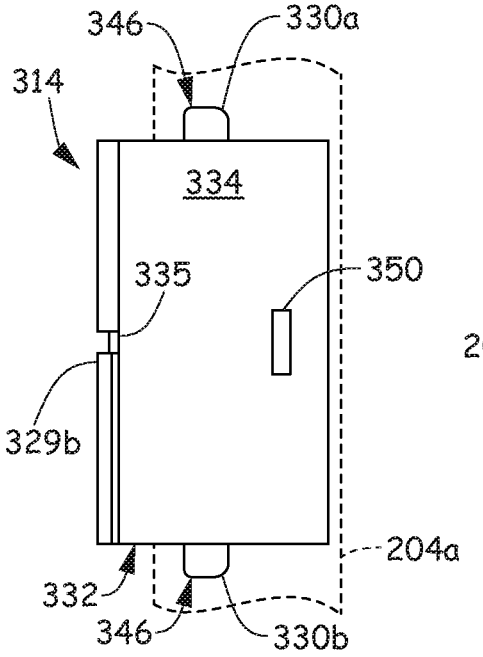
FIG. 11 is a front view of a mounting bracket assembly of the side cap retail display unit of FIGS. 2-7.
Figure 12:
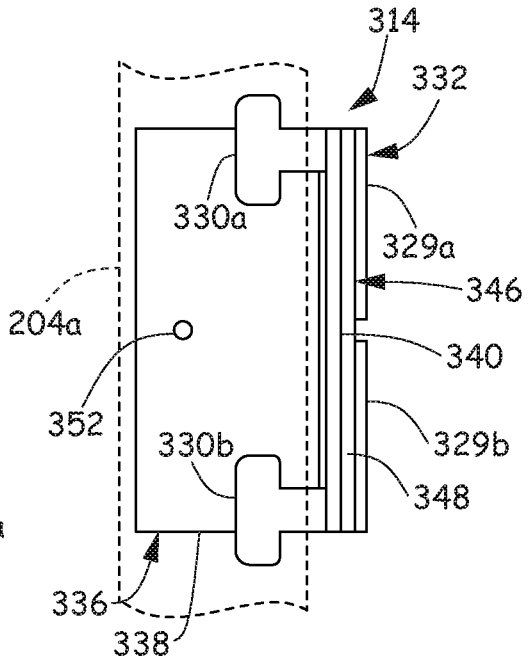
FIG. 12 is a back view of FIG. 11.
Figure 13:
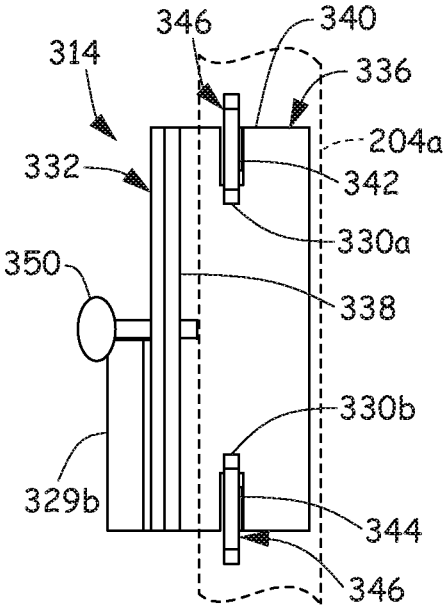
FIG. 13 is a right side view of FIG. 11.
Figure 14:
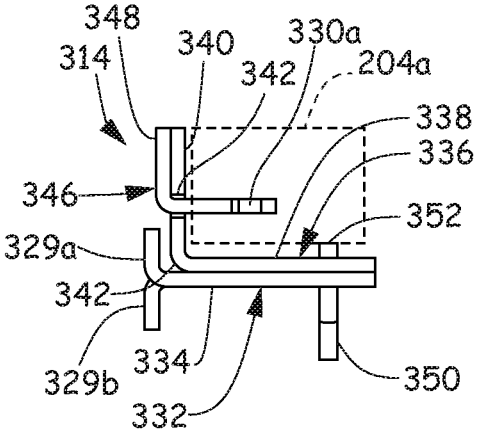
FIG. 14 is a top view of FIG. 11.

Side cap retail display unit 300 includes at least one mounting bracket assembly 314. As illustrated in the figures and under one embodiment, side cap 300 includes a pair of mounting bracket assemblies 314*a* and 314*b*. Mounting bracket assemblies 314*a* and 314*b* are coupled to sliders 326*a* and 326*b*, respectively, of wall 308 and are slidable within sliders 326*a* and 326*b*. FIG. 11 is a front view, FIG. 12 is a back view, FIG. 13 is a right side view and FIG. 14 is a top view of an exemplary mounting bracket assembly 314. Mounting bracket assembly 314 includes features for mating with a slider, such as slider 326*a* or 326*b* of wall 308, and features for attaching side cap retail display unit 300 to an upright, such as upright 204*a* or 204*b* of an end cap, such as end cap 200 of gondola display fixture 100. Mounting bracket assembly 314 includes at least one ear. As illustrated in the figures and under one embodiment, mounting bracket assembly includes a pair of ears 329*a* and 329*b* that are configured to engage with the slider. More particularly, pair of ears 329*a* and 329*b* are positioned in channels 325*a* and 325*b* and are configured to slidably move inside channels 325*a* and 325*b* and thereby slidably adjust the position of respective mounting bracket assemblies 314*a* and 314*b* along a length of respective sliders 326*a* and 326*b*. Mounting bracket assembly 314 also includes at least one flange. As is illustrated in the figures and under one embodiment, mounting bracket assembly 314 includes a pair of flanges 330*a* and 330*b* that are configured to mount side cap 300 to the upright (204*a* or 204*b*) on gondola display fixture 100. Each flange 330*a* and 330*b* includes an upwardly pointing leg and a downwardly pointing leg so flanges 330*a* and 330*b* can be hooked onto upright (204*a* or 204*b*) in either the first or the second positions discussed above. In FIGS. 11-14, upright 204*a* is illustrated in phantom so it is clear how mounting bracket assembly 314 mounts to an upright.

With reference back to FIGS. 2 and 3, each mounting bracket assembly 314*a* and 314*b* is coupled to a respective slider 326*a* and 326*b* with pair of ears 329*a* and 329*b*. Each slider 326*a* and 326*b* is mounted to first vertical frame member 320 using two fasteners. A first slider fastener 327*a* is located proximate the top or first end of each slider 326*a* and 326*b* and a second slider fastener 327*b* is located proximate the bottom or second end of each slider 326*a* and 326*b*. Heads of slider fasteners 327*a* and 327*b* protrude into channels 325*a* and 325*b* of each slider 326*a* and 326*b* so as to confine the pair of ears 329*a* and 329*b* to slide or move inside channel 325*a* and 325*b*. In other words, heads of fasteners 327*a* and 327*b* provides a first stop at a first end of each slider 326*a* and 326*b* and a second stop at a second end of each slider 326*a* and 326*b*.

As illustrated in FIGS. 11-14, each mounting bracket assembly 314*a* and 314*b* is made of three different bent pieces of bracket material, such as metal, including a first bracket piece 332, a second bracket piece 336 and a third bracket piece 346 that are fused together by, for example, welding. First bracket piece 332 includes a main planar portion 334 that is best shown from the front view and top view of mounting bracket assembly 314 (FIGS. 11 and 14). First bracket piece 332 also includes ears 329*a* and 329*b*. The ears 329*a* and 329*b* each bend out-of-plane from main planar portion 334 in two opposing directions at a notch 335 cut into the left side of main planar portion 334. Each ear 329*a* and 329*b* is oriented substantially perpendicular from main planar portion 334. Second bracket piece 336 includes a first planar portion 338 best shown from the back view, the right side view and the top view of mounting bracket assembly 314 (FIGS. 12, 13 and 14). Second bracket piece 336 also includes a second planar portion 340 that is oriented substantially perpendicular from first planar portion 338 by a bend 342. Second planar portion 340 includes a first notch 342 and a second notch 344 each notch intersecting horizontal edges of second bracket piece 336. Third bracket piece 346 includes a main planar portion 348 attached to an outer side of second planar portion 340 of second bracket piece 336 and is best shown from the top view of mounting bracket assembly 314 (FIG. 14). Third bracket piece 346 also includes pair of flanges 330*a* and 330*b*. The flanges 330*a* and 330*b* each bend out-of-plane from main planar portion 348 in the same direction relative to main planar portion 348 and are oriented substantially perpendicular from main planar portion 348. Each flange 330*a* and 330*b* passes at least partially through respective first and second notches 342 and 344 in second planar portion 340 of second bracket piece 336.

To mount side cap 300 to upright 204*a* of end cap 200 as illustrated in FIG. 1, the ears 329*a* and 329 *b* of each mounting bracket assembly 314*a* and 314*b* are adjusted, moved or slid along respective sliders 326*a* and 326*b* to a position that allows flanges 330*a* and 330*b* of each mounting bracket assembly 314*a* and 314*b* to mate with slots in upright 204*a* that are not occupied by mounts from shelves on end cap 200 and simultaneously keep a bottom of wall 308 justified with base deck 222 of end cap 200. With each mounting bracket assembly 314*a* and 314*b* positioned along respective sliders 326*a* and 326*b*, a securing mechanism secures mounting bracket assemblies 314*a* and 314*b* to upright 204*a*. In one embodiment, the securing mechanism is a thumbscrew 350 that extends through main planar portion 334 and first planar portion 338 and has a distal end 352 that is tightened against upright 204*a* to secure mounting bracket assemblies 314*a* and 314*b* and therefore side cap retail display unit 200 to upright 204*a*.

Figure 15:
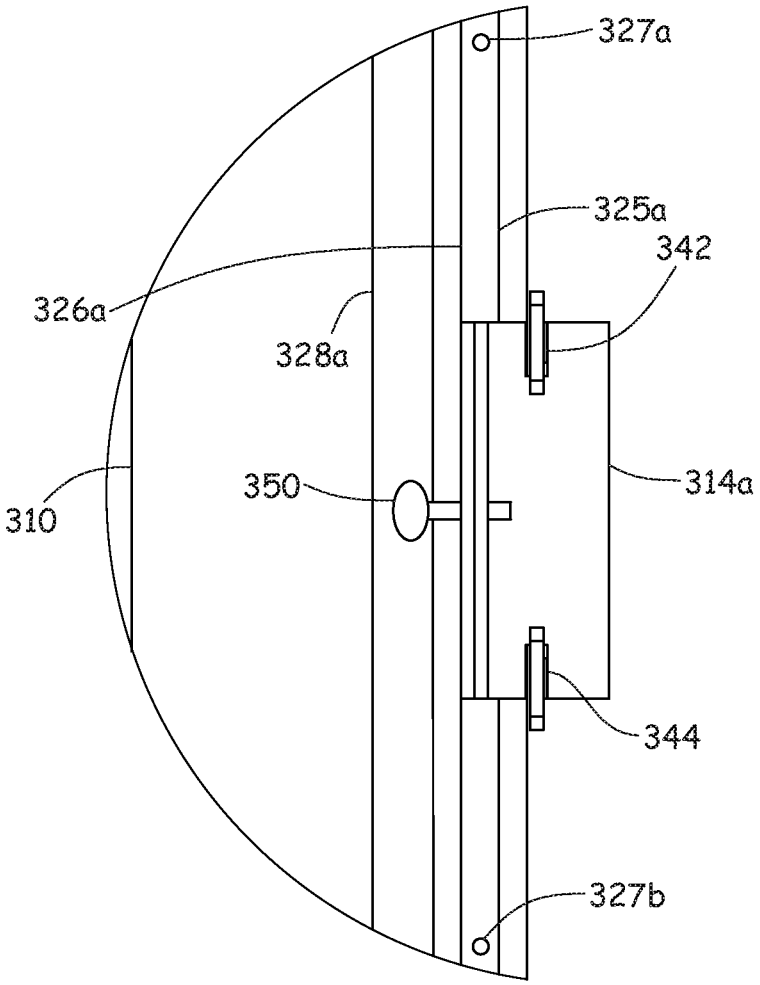
FIG. 15 is an enlarged view of a portion of FIG. 3 including the mounting bracket assembly of FIGS. 11-14 slidably coupled to the wall of FIGS. 8-10.
Figure 16:
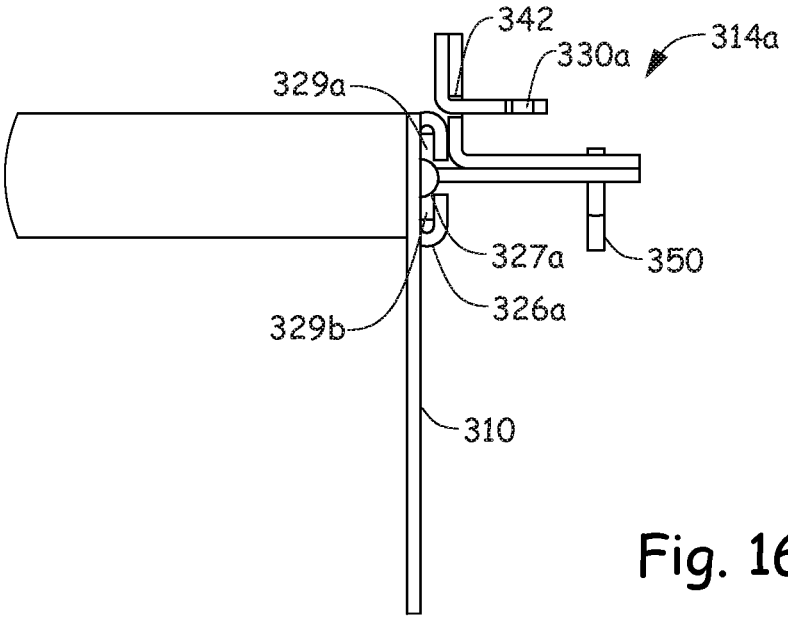
FIG. 16 is an enlarged view of a portion of FIG. 7 including the bracket assembly of FIGS. 11-14 slidably coupled to the wall of FIGS. 8-10.

FIG. 15 is an enlarged view of a portion of FIG. 3 including mounting bracket assembly 314*a* illustrated in detail in FIGS. 11-14 slidably movable along a length of slider 326*a* of wall 308 to a desirable position as illustrated in detail in FIGS. 8-10. FIG. 16 is an enlarged view of a portion of FIG. 7 including mounting bracket assembly 314*a* illustrated in detail in FIGS. 11-14 slidably coupled to slider 326*a* of wall 308 in FIGS. 8-10. As shown in FIGS. 15 and 16, ears 329*a* and 329*b* are slidably engaged with channel 325*a* of slider 326*a* with stops in the form of fasteners 327*a* and 327*b* located at each end of slider 326*a* to confine mounting bracket assembly 314*a* to a length of slider 326*a*. Mounting bracket assembly 314*a* satisfies three functions. First, mounting bracket assembly 314*a* provides position adjustment via ears 329*a* and 329*b* relative to channel 325*a* of slider 326*a*. Second, bracket assembly 314*a* provides flanges 330*a* and 330*b* for mounting side cap retail display unit 300 to an upright. Third, mounting bracket assembly 314*a* provides a mechanism for securing the adjustability of the first function through thumbscrew 350.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a wall having a panel supported by first and second horizontal frame members and first and second vertical frame members;

at least one slider attached to the first vertical frame member and including a channel, wherein the channel in the at least one slider comprises a lengthwise opening that faces outwardly from the first vertical frame member and openings at opposing ends of the at least one slider;

a first slider fastener that attaches a first end of the at least one slider to the first vertical member and a second slider fastener that attaches a second end of the at least one slider to the first vertical member;

at least one mounting bracket assembly slidably coupled to the at least one slider and comprising:

at least one ear positioned in the channel of the at least one slider, the at least one ear configured to slidably move inside the channel and thereby slidably adjust the position of the bracket assembly along a length of the at least one slider;

at least one flange configured to mount to an upright of another retail display unit; and a securing mechanism for tightening the at least one bracket assembly to the upright;

wherein the first slider fastener and the second slider fastener protrude into the channel of the at least one slider and provide a first stop at the first end of the at least one slider and a second stop at the second end of the at least one slider to confine the at least one ear inside the channel of the at least one slider.

2. The retail display unit of claim 1, the securing mechanism comprising a thumbscrew having a distal end, wherein the thumbscrew extends through a portion of the at least one bracket assembly and is configured to tighten against the upright.

3. The retail display unit of claim 1, wherein the at least one mounting bracket assembly comprises three pieces of material fused together including a first bracket piece having the at least one ear, a second bracket piece and a third bracket piece having the at least one flange, wherein the second bracket piece connects the first bracket piece to the third bracket piece.

4. The retail display unit of claim 3, wherein the first bracket piece comprises a main planar portion bent out of plane from the at least one ear.

5. The retail display unit of claim 4, wherein the second bracket piece comprises a first planar portion connected the main planar portion of the first bracket piece and a second planar portion bent out-of-plane from the first planar portion of the second bracket piece.

6. The retail display unit of claim 5, wherein the third bracket piece comprises a main planar portion connected to the second planar portion of the second bracket piece and the at least one flange is bent out-of-plane from the main planar portion.

7. The retail display unit of claim 1, wherein the wall is oriented in a first position or a second position, wherein in the first position the first vertical member and the channel are on a right side of the wall, wherein in the second position the wall is turned upside down and the first vertical member and the channel are on the a left side of the wall.

8. A retail display unit comprising:

an end cap retail display unit including first and second vertical uprights, a back wall supported between the first and second vertical uprights and a base deck;

a side cap retail display unit coupled to the first vertical upright of the end cap display unit, the side cap retail display unit comprising:

a wall including a panel supported by lower and upper horizontal members and first and second vertical side members;

at least one slider coupled to the first vertical member and including a channel that faces outwardly;

at least one mounting bracket assembly having a first portion configured to mate with the channel and slidably move along a length of the at least one slider to a desirable position and a second portion configured to mount to the first vertical upright of the end cap display unit such that the first vertical side member of the side cap retail display unit is coupled to the first vertical upright of the end cap display unit, wherein the desirable position ensures that the lower horizontal member is justified with the base deck of the end cap retail display unit and the at least one mounting bracket assembly does not interfere with shelves mounted to the first vertical upright of the end cap retail display unit; and a securing mechanism for tightening the at least one mounting bracket assembly to the first vertical upright.

9. The retail display unit of claim 8, wherein the channel in the at least one slider comprises a lengthwise opening and openings at opposing ends of the at least one slider.

10. The retail display unit of claim 9, further comprising a first slider fastener that attaches a first end of the at least one slider to the first vertical side member and a second slider fastener that attaches a second end of the at least one slider to the first vertical side member, wherein heads of the first fastener slider and the second fastener slider protrude into the channel of the at least one slider and provide a first stop at the first end of the at least one slider and a second stop at the second end of the at least one slider to confine the at least mounting bracket assembly to the length of the channel.

11. The retail display unit of claim 8, the securing mechanism comprising a thumbscrew having a distal end, wherein the thumbscrew extends through a portion of the at least one bracket assembly and is configured to tighten against the first vertical upright.

12. The retail display unit of claim 8, wherein the first portion of the at least one mounting bracket assembly comprises at least one ear that mates with the channel of the at least one slider and the second portion of the at least one mounting bracket assembly comprises at least one flange that mounts to the upright.

13. The retail display unit of claim 12, wherein the at least one mounting bracket assembly comprises three pieces of material fused together including a first bracket piece having the at least one ear, a second bracket piece and a third bracket piece having the at least one flange, wherein the second bracket piece connects the first bracket piece to the third bracket piece.

14. The retail display unit of claim 8, wherein the wall of the side cap retail display unit is oriented in a first position or a second position, wherein in the first position the first vertical side member and the channel are on a right side of the wall, wherein in the second position the wall is turned upside down and the first vertical side member and the channel are on a left side.

15. A method of mounting a side cap retail display unit to an endcap retail display unit, the method comprising:

sliding at least one ear of at least one mounting bracket assembly along a channel of a slider to a desirable position, the slider being fixed to a first vertical frame member of a wall of the side cap retail display unit, the first vertical frame member defining a first side of the side cap retail display unit;

mounting at least one flange of the at least one mounting bracket assembly to a vertical upright of the endcap display unit, the vertical upright defining a side of the endcap retail display unit; and securing the at least one mounting bracket assembly to the vertical upright of the endcap display unit; and wherein the desirable position of the at least one mounting bracket assembly along the channel of the slider ensures that a bottom of the wall of the side cap retail display unit is justified with a base deck of the endcap display unit while the at least one flange of the at least one mounting bracket assembly does not interfere with shelves of the endcap display unit that are mounted to the vertical upright.

16. The method of claim 15, wherein sliding the at least one ear of the at least one mounting bracket assembly comprises sliding the at least one ear between a first stop and a second stop, wherein the first stop comprises a first fastener that attaches a first end of the at least one slider to the first vertical frame member and the second stop comprises a second fastener that attaches a second end of the at least one slider to the first vertical frame member.

17. The method of claim 15, wherein mounting the at least one flange of the at least one mounting bracket assembly to the vertical upright comprises mounting the at least one flange of the at least one mounting bracket assembly into at least one slot of the vertical upright.

18. The method of claim 15, wherein securing the at least one mounting bracket assembly to the vertical upright comprises securing the at least one mounting bracket assembly to the vertical upright using a thumbscrew that extends through a portion of the at least one mounting bracket assembly and includes a distal end that is held against the vertical upright.

* * * * *